US008172361B2

(12) United States Patent
Takahashi

(10) Patent No.: US 8,172,361 B2
(45) Date of Patent: May 8, 2012

(54) LIQUID EJECTING APPARATUS AND CAPPING METHOD IN LIQUID EJECTING APPARATUS

(75) Inventor: Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 972 days.

(21) Appl. No.: 12/169,905

(22) Filed: Jul. 9, 2008

(65) Prior Publication Data

US 2009/0015627 A1 Jan. 15, 2009

(30) Foreign Application Priority Data

Jul. 13, 2007 (JP) ..... 2007-184247

(51) Int. Cl.
*B41J 2/165* (2006.01)

(52) U.S. Cl. ..... 347/32

(58) Field of Classification Search ..... 347/32
See application file for complete search history.

(56) References Cited

U.S. PATENT DOCUMENTS

2006/0119640 A1* 6/2006 Berry et al. ..... 347/29

FOREIGN PATENT DOCUMENTS

| | | |
|---|---|---|
| JP | 02-048958 | 2/1990 |
| JP | 05-116330 | 5/1993 |
| JP | 2004-291273 | 10/2004 |
| JP | 2005-067127 | 3/2005 |
| JP | 2006-021336 | 1/2006 |
| JP | 2007-069448 | 3/2007 |

* cited by examiner

*Primary Examiner* — Jerry Rahll
(74) *Attorney, Agent, or Firm* — Workman Nydegger

(57) ABSTRACT

A liquid ejecting apparatus includes a liquid ejecting heads that ejects a liquid onto a target, a transport unit that transports the target, cap units that include caps which are provided opposite to the liquid ejecting heads with a transport path of the target interposed therebetween, and cover units that include cover members. The cap units are movable between a capping position where the caps come into contact with the liquid ejecting heads and a retreated position where the caps are separated from the liquid ejecting heads. The cover units are driven to move the cover members in association with the transport unit such that the cover members are disposed at a closing position where the caps are covered by the cover members when the target is being transported and the cover members are disposed at an opening position that does not cover the caps during a capping operation.

13 Claims, 10 Drawing Sheets

LIQUID EJECTING APPARATUS AND CAPPING METHOD IN LIQUID EJECTING APPARATUS

BACKGROUND OF THE INVENTION

The entire disclosure of Japanese Patent Application No. 2007-184247, filed Jul. 13, 2007, is expressly incorporated herein by reference.

1.Technical Field

The present invention relates to a liquid ejecting apparatus. More specifically, the present invention relates to a liquid ejecting apparatus which includes a movable cap which is capable of capping the liquid ejecting heads of the liquid ejecting apparatus.

2. Related Art

On example of a liquid ejecting apparatus currently known in the art which includes cap units is the line printer disclosed in the published Japanese Patent Application Nos. JP-A-2007-69448 (see paragraphs [0050], [0051], and FIGS. 7 and 8) and JP-A-2005-67127 (see paragraph [0055], and FIGS. 2B and 12). In each description, the line printer includes a plurality of transport belts capable of transporting sheets of paper through the printer, liquid ejecting heads that are arranged in zigzag positions which correspond to the gaps between the plurality of transport belts, and cap units or head recovery units that are provided below the recording heads at locations that correspond to the gaps between the transport belts. Each of the cap units comprises a cap with a surface that corresponds to the nozzles of the recording heads. When the printer is not performing a printing operation, the cap comes into contact with the surface of the recording head in order to cap the nozzles of the recording head, in order to prevent an increase in the viscosity of ink in the nozzles and the ink from drying.

The cap unit also includes a suction pump which acts as a suction unit. The suction pump is driven when the caps are in a capping state in order to create a negative internal pressure in the caps, which forcibly sucks and discharges any high-viscosity ink or bubbles that may have formed in the nozzles. In this way, the nozzles are cleaned. Because the recording heads are at fixed locations within the line printer, the caps are disposed at positions which face the recording heads. During a printing operation wherein sheets are transported through the printer, the caps are moved downward into a retreated position so as not to hinder the transportation of the sheet.

When a printing operation is not being performed and the printer is in print standby mode, no paper is being transported through the printer, so the caps are moved upward to a capping position where the caps come into contact with the nozzle surface of the recording heads.

However, in the line head printer described above, the sheet is transported between the recording heads and the caps during the printing operation. Unfortunately, however, as the paper is transported through the printer, powder is likely to be generated due to the friction between the sheet of paper and the rollers or belts of the transporting system. Tis powder may adhere to the caps.

Japanese Patent Application No. JP-2005-116330 discloses a serial printer which includes cap covers that cover caps when the caps are moved away from the recording heads. In this printer, since the caps are arranged away from the printing area, it is possible to prevent the paper powder from adhering to the caps.

However, in the line printer described above, the caps are always arranged below the recording heads, regardless of whether or not the printer is performing a printing operation, meaning that the paper powder generated from the sheet may adhere to the caps. This creates a number of difficulties. For instance, when the paper powder is adheres to the sealing members of the caps, gaps may form between the nozzle surfaces of the recording heads and the sealing members of the caps, which may cause capping errors and a less effective seal between the caps and the recording head. In addition, it is difficult to remove the paper powder once it is adhered to the sealing members of the caps.

The capping errors lower the sealing performance of the caps, and cause an increase in the viscosity of ink in the capped nozzles, resulting in clogged nozzles. The low sealing performance of the caps may accelerate the drying of ink remaining in the caps and may also clog the ink discharge tube connected to the caps. In addition, the ink in the caps is used to maintain the humidity in the caps during the capping operation, which makes it possible to prevent an increase in the viscosity of ink in the nozzles. However, when the ink remaining in the caps is dried due to the capping error, the humidity is lowered, and the nozzles are more likely to be clogged.

BRIEF SUMMARY OF THE INVENTION

An advantage of some aspects of the invention is that provides a liquid ejecting apparatus capable of effectively preventing foreign materials, such as dust, which may be generated from transporting a target, from adhering to caps located beneath the liquid ejecting heads.

A first aspect of the invention is a liquid ejecting apparatus including a plurality of liquid ejecting heads that eject a liquid onto a target, a transport unit that transports the target, cap units that include caps which are provided opposite to the liquid ejecting heads with a transport path of the target interposed therebetween, the caps being movable between a capping position where the caps come into contact with the liquid ejecting heads and a retreated position where the caps are separated from the liquid ejecting heads, and cover units that include cover members which may be driven in association with the transport unit such that the cover members may be moved to a closing position wherein the caps are covered while the target is transported and an opening position wherein the cover members do not cover the caps.

A second aspect of the invention, is a capping method in a liquid ejecting apparatus including a transport unit that transports a target, liquid ejecting heads that eject a liquid onto the transported target, and cap units having caps that cap the liquid ejecting heads. The method includes moving cover members to a capping position where the cover members cover the caps while the target is being transported, and moving the cover members to an opening position where the cover members do not hinder the movement of the caps between a retreated position and the capping position when the liquid ejecting heads are being capped by the caps.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of the invention will be described with reference to FIGS. 1 to 10.

Figure 1:
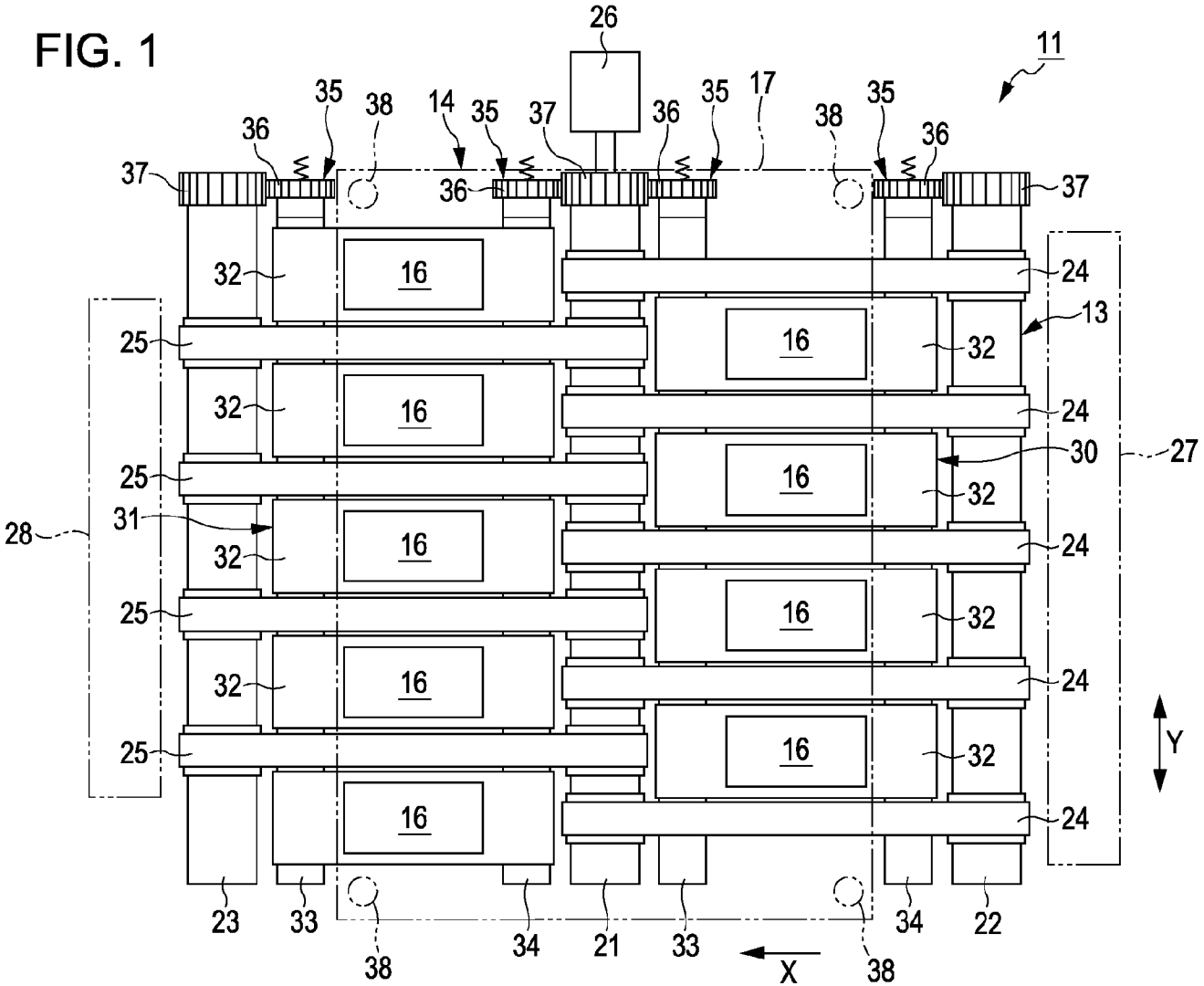
FIG. 1 is a plan view illustrating a printer according to a first embodiment of the invention.
Figure 2:
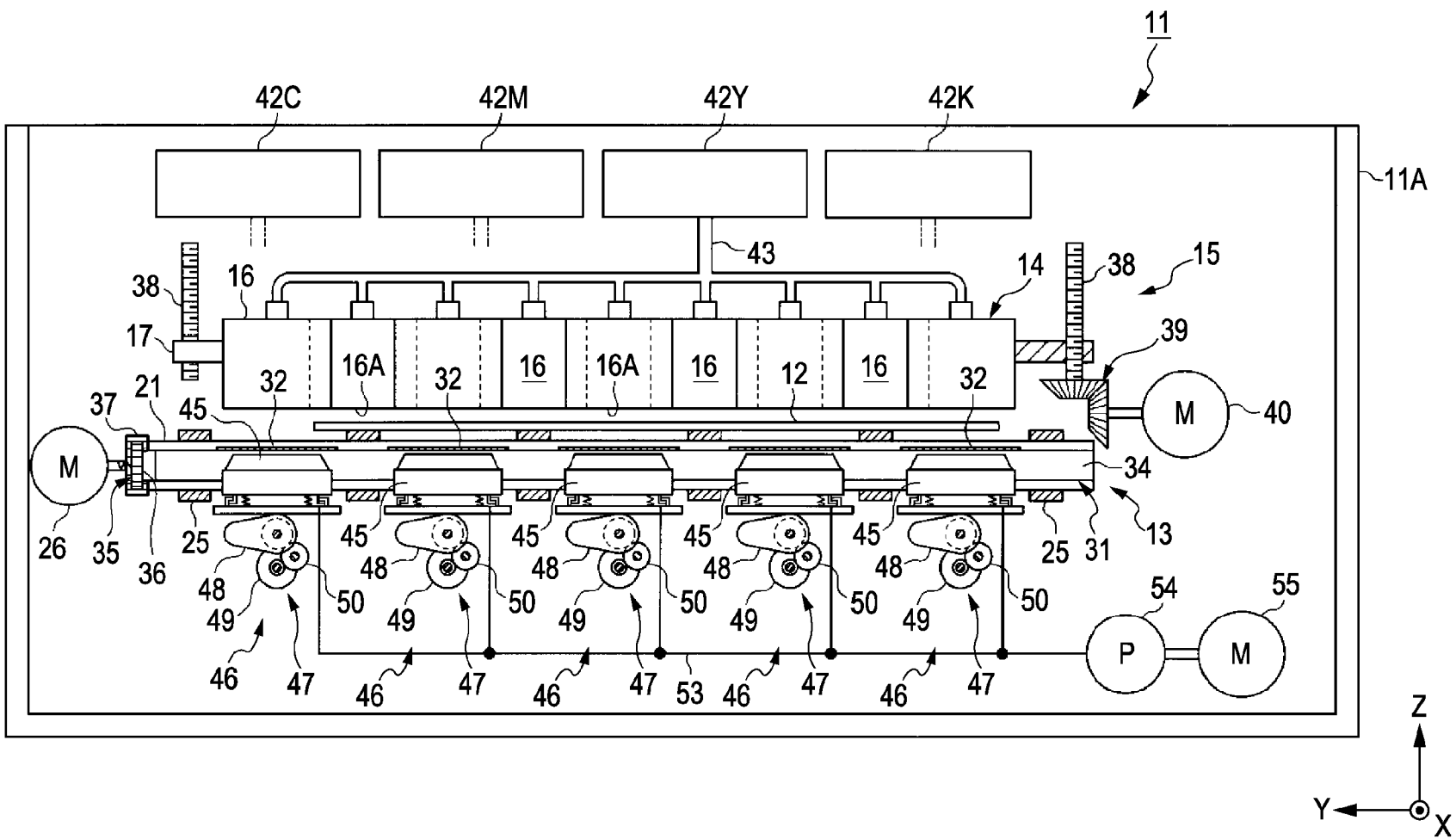
FIG. 2 is a front cross-sectional view of the printer of FIG. 1.
Figure 3:
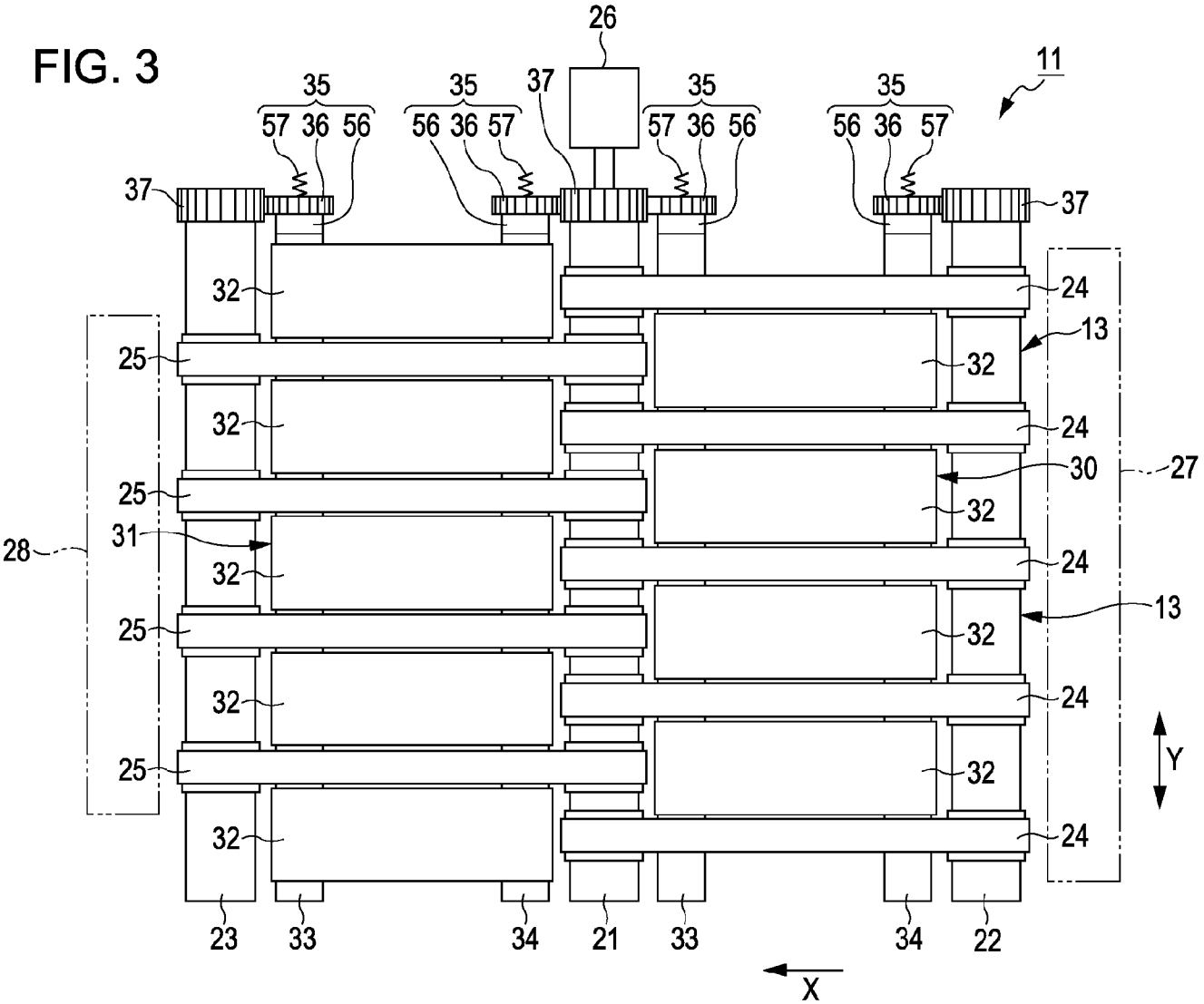
FIG. 3 is a plan view illustrating a transport unit and cover units when a sheet is being transported through the printer of FIG. 1.
Figure 4:
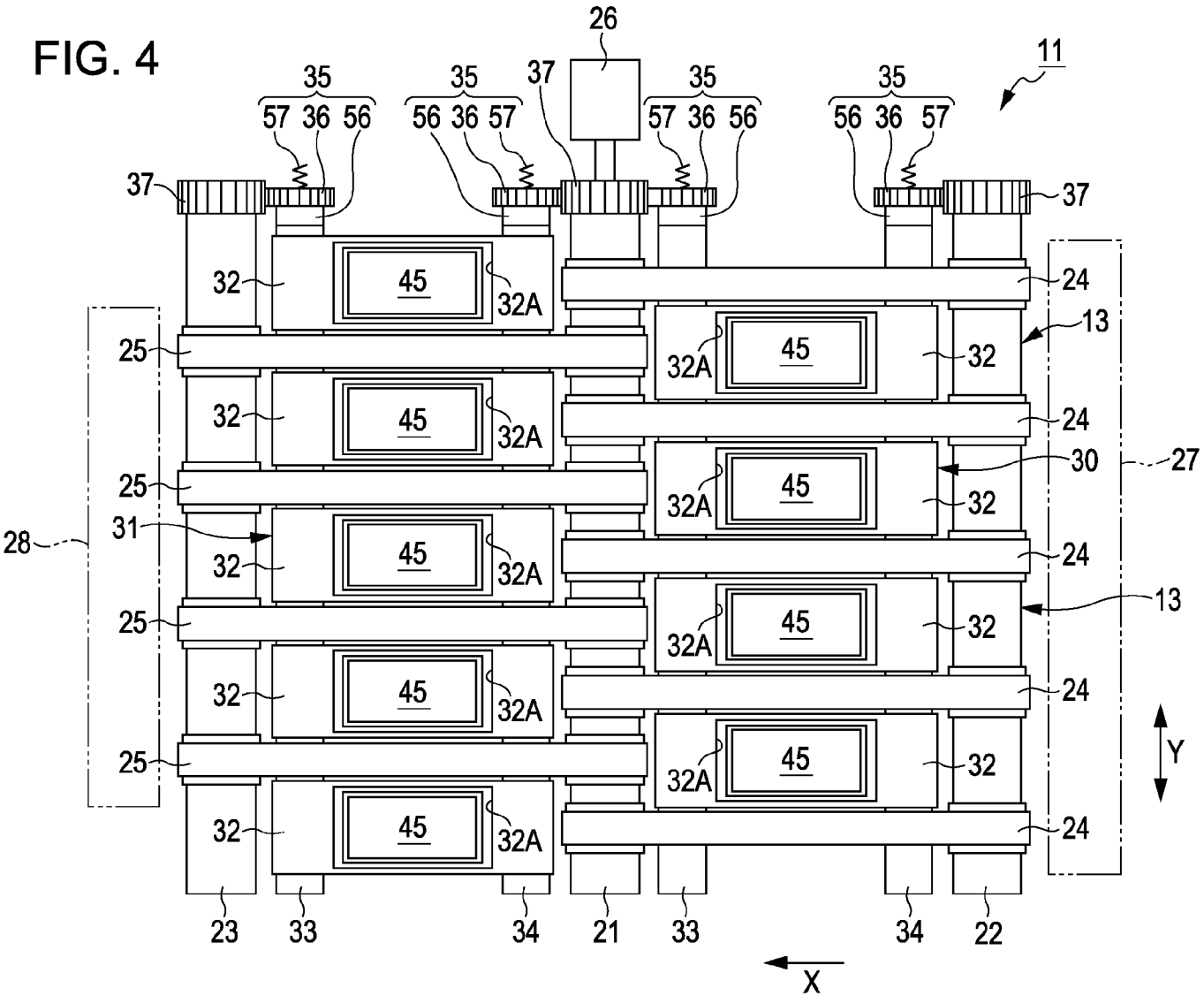
FIG. 4 is a plan view illustrating the transport unit and the cover units of the printer of FIG. 1 during a capping operation.
Figure 5:
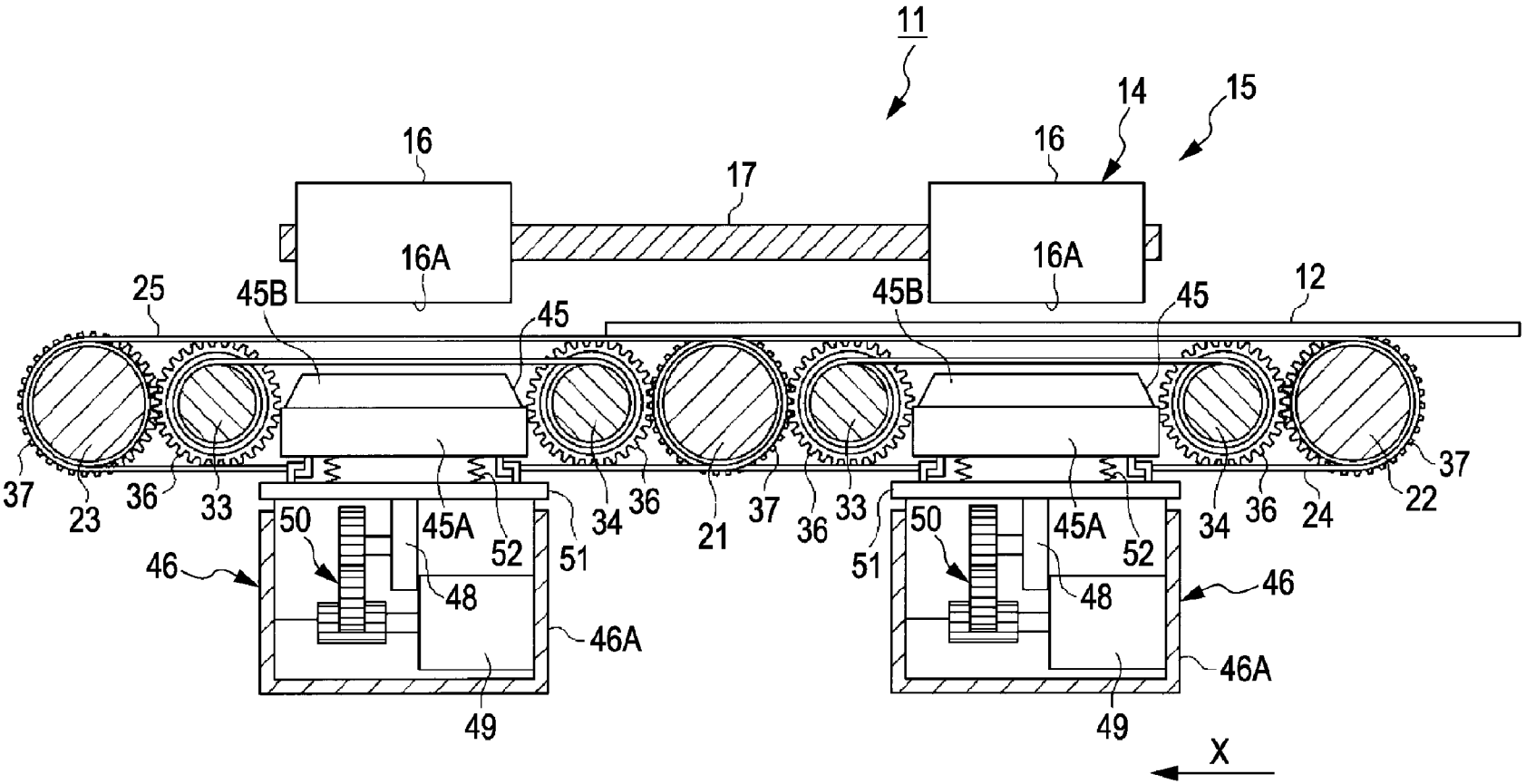
FIG. 5 is a side cross-sectional view illustrating the printer of FIG. 1.

FIG. 1 is a plan view illustrating an ink jet recording apparatus, which is an example of a liquid ejecting apparatus capable of performing aspects of the invention. FIG. 2 is a front cross-sectional view illustrating the ink jet recording apparatus. FIGS. 3 and 4 are plan views illustrating the ink jet recording apparatus as viewed from the lower surface of a line head, and FIG. 5 is a side cross-sectional view of the ink jet recording apparatus. In FIGS. 1 and 5, the ink supply system of the ink recording apparatus is not shown.

As shown in FIGS. 1 and 2, the ink jet recording apparatus (hereinafter, referred to as a printer 11) includes a box-shaped body case 11A (shown in FIG. 2) with an opened top surface, a transport unit 13 that transports a sheet of paper 12 acting as a target medium (which is shown in FIG. 2), and an ejecting unit 15 that includes a line head 14 which is capable of discharging ink droplets onto the sheet of paper 12. The transport unit 13 and the ejecting unit 15 are provided in the body case 11A. In this embodiment, the line head 14 includes a plurality of recording heads 16 (nine in this embodiment) that are arranged in a zigzag configuration in a Y direction which is orthogonal to the X direction that the sheet of paper 12 is transported through the printer 11. The recording heads 16 are arranged so as to extend beyond the width of the sheet of paper 12. A head support member 17 supports the recording heads 16.

As shown in FIGS. 1 and 2, the transport unit 13 is provided below the line head 14 and includes three rollers 21-23 which are arranged in parallel to each other such that their axial directions are aligned with the Y direction. The central roller 21 serves as a driving roller, and the rollers 22 and 23 provided at both sides of the central roller serve as driven rollers. Five seamless transport belts 24 extend in the X direction and are wound around the rollers 21 and 22 provided on the upstream side (the right side of FIG. 1) in the transport direction. The seamless transport belts 24 are located at predetermined intervals along the Y direction. Meanwhile, four seamless transport belts 25 extend in the X direction and are wound around the rollers 21 and 23 provided on the downstream side in the transport direction at predetermined intervals in the Y direction so that they deviate from the positions of the transport belts 24 by half the pitch in the Y direction.

The central driving roller 21 is connected to an electromotive motor 26 directly or with a reduction mechanism interposed therebetween so as to be driven by the electromotive motor 26. When the electromotive motor 26 is driven, the central roller 21 rotates, causing the transport belts 24 and 25 to rotate, and the sheet of paper 12 to be fed from a sheet feed unit 27 in the transport or X direction while being sequentially loaded on the transport belts 24 and 25. Then, the sheet of paper 12 is transported to the downstream side of the transport belt 25 to a sheet discharging unit 28. In this embodiment, the transport unit 13 is an electrostatic attraction type that can transport the sheet of paper 12 while attracting the sheet of paper 12 to the surface of the transport belts 24 and 25 using an electrostatic force generated in the transport belts 24 and 25.

In this embodiment, as shown in the plan view of FIG. 1, the three rollers 21-23 and the transport belts 24 and 25 are arranged so as to avoid a plurality of recording heads 16. Therefore, during a printing operation, the caps 45 are provided below the plurality of recording heads 16 such that the caps 45 and recording heads 16 face each other between the transport belts 24 and 25, as shown in FIGS. 2 and 4. The caps 45 are for capping the nozzle surfaces 16A (see FIGS. 2 and 6) of the recording heads 16 where the nozzle openings where the ink droplets are discharged are formed. During the printing operation, a sheet of paper 12 is transported between the recording heads 16 and the caps 45 while being loaded on the transport belts 24 and 25.

As shown in FIG. 1, a set of cover units 30 and 31 are provided among the three rollers 21-23 forming the transport unit 13. The cover units 30 and 31 are for covering or protecting the caps 45 with flat belts 32, which are cover members. By covering the caps 45 with the flat belts 32, it is possible to prevent dust including, for example, paper powder generated from the sheet of paper 12 during transport from adhering to the caps 45. Each of the flat belts 32 is wound around a pair of rollers 33 and 34, such that the pair of rollers 33 and 34 are operatively associated with the rollers 21-23. A friction clutch gear mechanism 35 is provided at one end of each of the rollers 33 and 34, and a gear 36 forming the friction clutch gear mechanism 35 is engaged with a gear 37 that is fixed to one end of each of the rollers 21-23. Therefore, when the electromotive motor 26 is driven to operate the transport unit 13, the flat belts 32 are driven in association with the transport unit 13. The detailed structure of the cover units 30 and 31 will be described below.

For example, four driving shafts 38 (two are shown in FIG. 1) are vertically provided in the body case 11A while being supported by a frame (not shown). In one embodiment, the four driving shafts 38 comprise screw shafts. The four driving shafts 38 are fitted into screw holes formed in four corners of the head support member 17 in order to support the head support member 17.

The four driving shafts 38 are connected to each other through a power transmission mechanism (not shown) such that they can synchronously rotate. Among the four driving shafts, one driving shaft 38 is connected to a lift motor 40 through a gear mechanism 39 so as to transmit power. Therefore, when the lift motor 40 is rotated forward or backward, the line head 14 can be lifted up in the Z direction of FIG. 1. In addition, the may be line head 14 lifted in order to adjust the gap between the recording heads 16 and the sheet of paper 12 or the gap between the recording heads 16 and the upper surfaces of the transport belts 24 and 25.

As shown in FIG. 2, four color ink cartridges 42C, 42M, 42Y, and 42K respectively contain four color inks, such as cyan (C), magenta (M), yellow (Y), and black (K). The ink cartridges 42C, 42M, 42Y, and 42K are provided at predetermined positions with in the body case 11A. Ink from each of the ink cartridges 42C, 42M, 42Y, and 42K is supplied to the corresponding recording head 16 through an ink supply tube 43 (only one ink supply tube is shown in FIG. 2). In addition, a liquid supply source may be provided with an ink tank, instead of the ink cartridge. Ink may be supplied by, for example, a difference in the water head or a pressurized gas supply method using pressurized air, wherein. The pressurized gas supply method may include a pressing method which uses a spring and a pressing method which uses the magnetic force of a magnet.

Figure 6:
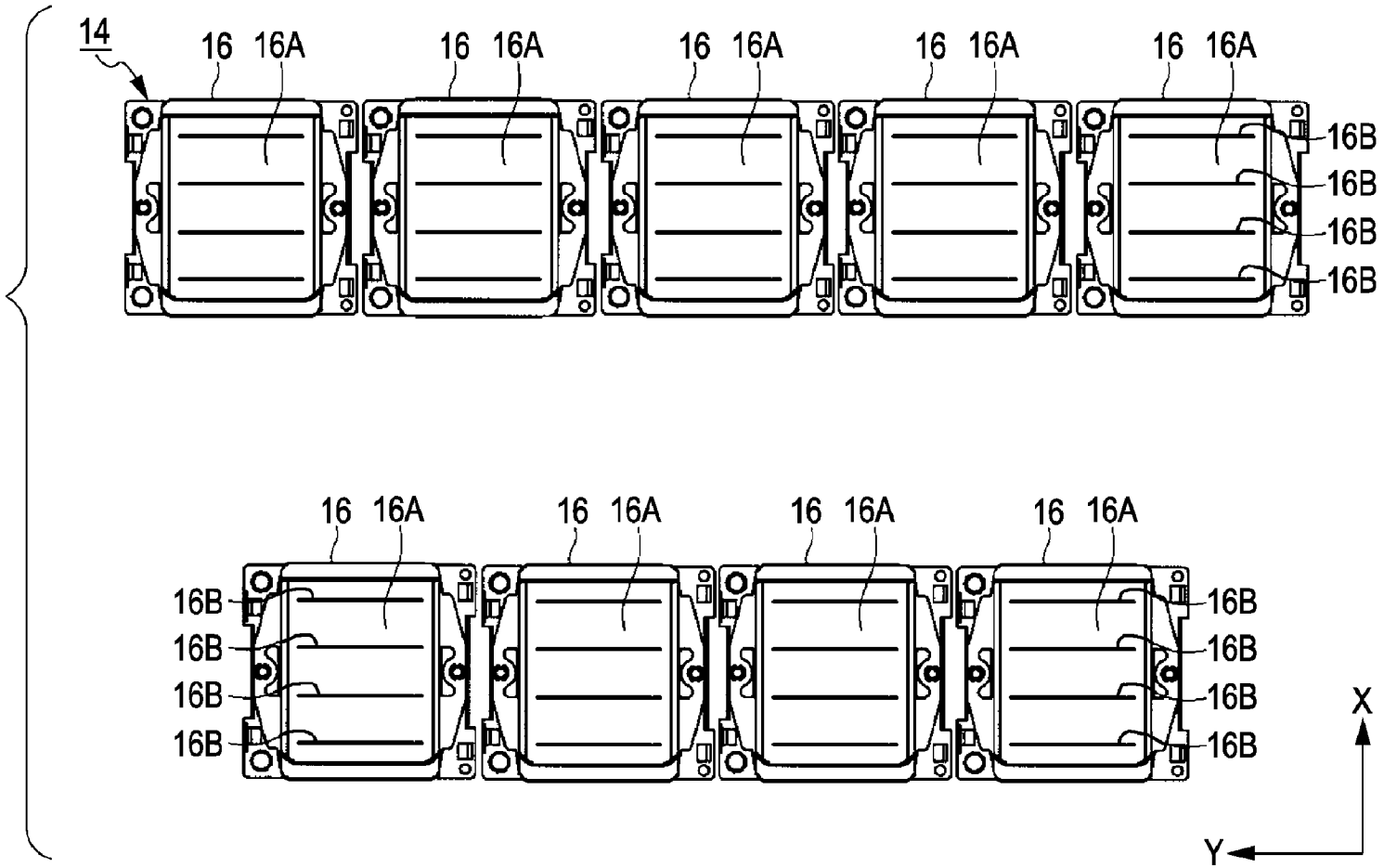
FIG. 6 is a bottom view illustrating a line recording head.

FIG. 6 is a bottom view illustrating the line head, as viewed from a nozzle opening surface. In FIG. 6, the head support member is not shown. Four nozzle lines 16B which correspond to the four color inks are formed in the nozzle surface 16A of each of the plurality of recording heads 16. One nozzle line 16B is composed of a plurality of (for example, 180) nozzles arranged in a zigzag configuration. Four flow passages corresponding to the four nozzle lines 16B are formed in the recording head 16, and each color ink is supplied through the corresponding flow passage. Therefore, the nozzles in the same nozzle line 16B discharge the same color ink.

In the recording head 16, a discharge driving element (not shown) is provided for each nozzle. When the discharge driving element is driven, a discharge force is created, and ink droplets are discharged from the nozzles. Any of the following discharge driving methods may be used: a piezoelectric method using a piezoelectric vibration element as the discharge driving element; an electrostatic method using an electrostatic driving element; and a thermal method that obtains a discharge force using film boiling of ink caused by heat generated from a heater.

Since the recording heads 16 are arranged in a zigzag configuration, a positional relationship is established between the nozzle lines in a first column of recording heads 16 (the top line of recording heads shown in FIG. 6) and the nozzle lines in a second column of recordings heads 16 (the bottom line of recording heads shown in FIG. 6). More specifically, the nozzles of the nozzle lines in the first and second columns of the recording heads overlap each other at least one end of each of the nozzle lines, or the nozzles disposed at both ends of each of the nozzle lines in the first and second columns of recording heads are arranged at nozzle pitches. Therefore, since the nozzles are arranged beyond the maximum width range of the sheet, it is possible to print an image on the sheet of paper 12 by only moving the sheet of paper 12 through the printer while the line head 14 is fixed.

Next, the structure of the cap unit will be described. As shown in FIG. 2, a plurality of cap units 46 (five cap units are shown on the lower side of FIG. 2) are provided below the recording heads 16, each of which includes the cap 45. As shown in FIG. 2, the cap unit 46 includes the cap 45 that caps the nozzle surface 16A of the recording head 16 and a lift mechanism 47 that lifts the cap 45. The lift mechanism 47 includes a cam 48 (rotary cam) that comes into contact with the bottom of the cap 45, an electromotive motor 49 that outputs power to rotate the cam 48 forward and backward, and a gear train 50 that transmits the power of the electromotive motor 49 to the cam 48. In addition, the lift mechanism 47 may adopt a mechanism using a cylindrical cam instead of the mechanism using the rotary cam 48. Further, instead of the electromotive motor 49, for example, a cylinder, a solenoid, or a piezoelectric actuator may be used as a power source.

Figure 9B:
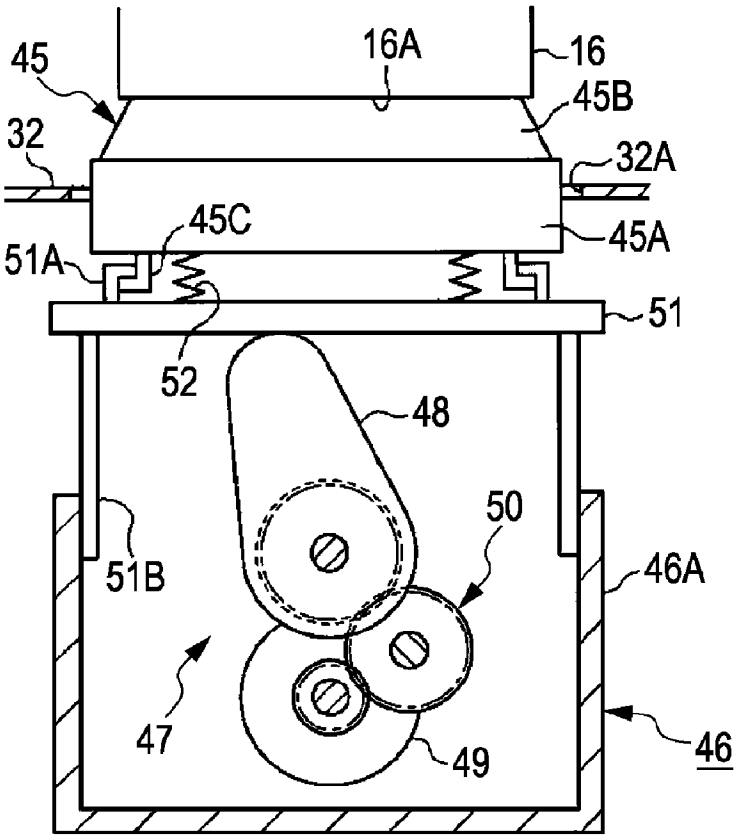
FIGS. 9A and 9B are front cross-sectional views illustrating the structure and operation of a cap unit.
Figure 9A:
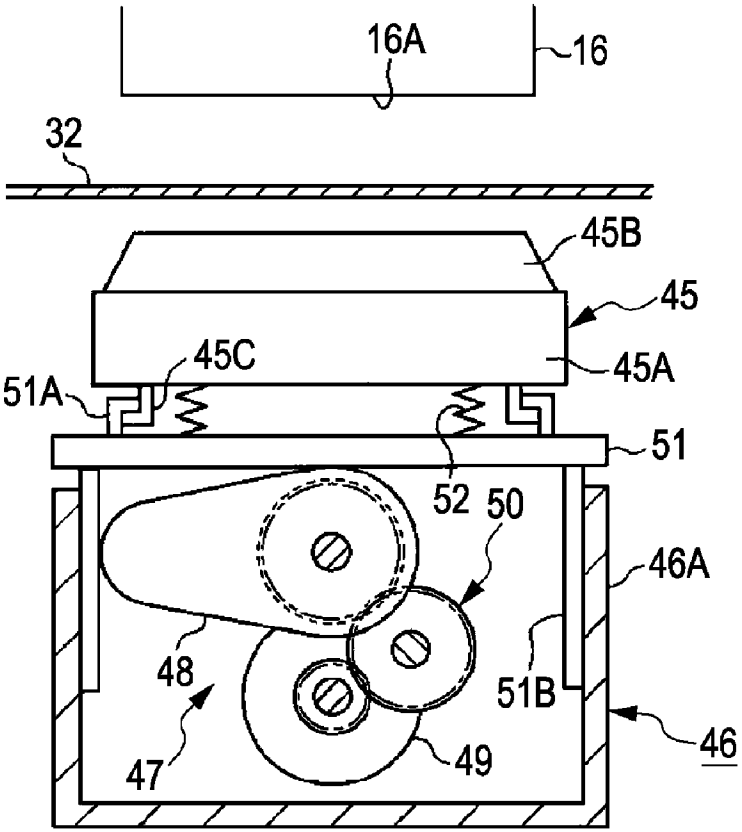

FIGS. 9A and 9B are front cross-sectional views illustrating the cap unit. Specifically, FIG. 9A shows the cap disposed at a retreated position and FIG. 9B is the cap disposed at a capping position. When the electromotive motor 49 is rotated forward when the cap 45 disposed at the retreated position shown in FIG. 9A, the cam 48 is rotated in the clockwise direction to lift up the cap 45 up to the capping position shown in FIG. 9B. Meanwhile, when the electromotive motor 49 is rotated backward with the cap 45 is at the capping position, the cam 48 is rotated in the counterclockwise direction, and the cap 45 falls to the retreated position shown in FIG. 9A. In addition, the cap 45 may be disposed at a flushing position, which is an intermediate position between the retreated position and the capping position. The term 'flushing' means a process wherein ink droplets are discharged in an area other than the sheet (in this embodiment, into the caps 45) at a predetermined time interval measured by a timer or whenever printing is performed once, in order to prevent clogs from forming in the nozzle due to an increase in the viscosity of ink in the nozzles when the printer is idle.

The cap 45 includes a cap supporting member 45A having a rectangular box shape with an opened upper surface and a sealing member 45B that is formed of an elastic material (for example, elastomer) having a substantially rectangular ring shape (see FIG. 8B), which is fixed to the upper edge of the cap supporting member. For example, the cap supporting member and the sealing material are colored with two colors. As shown in FIGS. 9A and 9B, the cap 45 is urged upward by the elastic force of a spring 52 that is provided between the bottom of the cap 45 and the support plate 51, with the upper limit position being restricted by the engagement between engaging portions 45C and 51A. A guide 51B extends from the support plate 51 downward and is guided by, for example, a guide concave portion (not shown) that is formed in the inner wall of the case 46A.

Referring to FIG. 2 again, each of the caps 45 is connected to an outlet of a suction pump 54 through a tube 53. The suction pump 54 is connected to a pump motor 55 such that it can receive power from the pump motor. When the pump motor 55 is driven, the suction pump performs a suction operation. When the pump motor 55 is driven in the capping state in which the cap 45 comes into contact with the nozzle surface 16A of the recording head 16, a sucking force is applied to each of the caps 45 through the tube 53 in order to create a negative internal pressure within the cap 45, thereby performing a cleaning process wherein ink is forcibly sucked and removed in order to eliminate high-viscosity ink in the nozzles or bubbles in the ink.

Next, the structure of the cover unit will be described. In the printer 11 according to this embodiment, the cover units 30 and 31, as shown in FIGS. 1, 3, and 4. Each cover unit 30 and 31 has the flat belts 32 at positions corresponding to the recording heads 16 and the cap units 46. The flat belt 32 serves as a cover member that prevents paper powder from adhering to the cap 45 (particularly, the sealing member 45B). The cover unit 30 on the upstream side covers four caps 45 corresponding to a first column of recording heads 16 provided on the upstream side, and the cover unit 31 on the downstream side covers five caps 45 corresponding to a second column (five) of recording heads 16 provided on the downstream side.

As shown in FIGS. 3, 4, 5, 8A, and 8B, each of the cover units 30 and 31 includes a first roller 33 and second roller 34 that are disposed on both sides of the caps 45 between the flat belts 32 that are wound around the first and second rollers 33 and 34. The width of the flat belt 32 in the Y direction is larger than that of the cap 45, and the overall length thereof is two or more times larger than the overall length of the cap 45 in the transport direction. In addition, the flat belt 32 is wound around the rollers 33 and 34 such that one end of the flat belt 32 is fixed to the first roller 33 and the other end thereof is fixed to the second roller 34. Therefore, the flat belt 32 horizontally extends between the rollers 33 and 34.

Figure 8A:
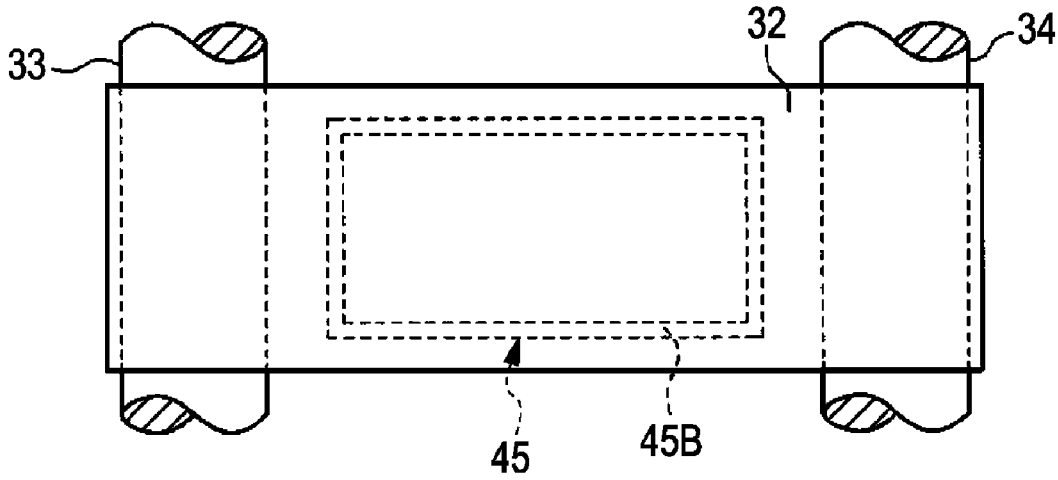
FIG. 8A is a partial view illustrating the cover unit wherein a flat belt is disposed at a covering position.
Figure 8B:
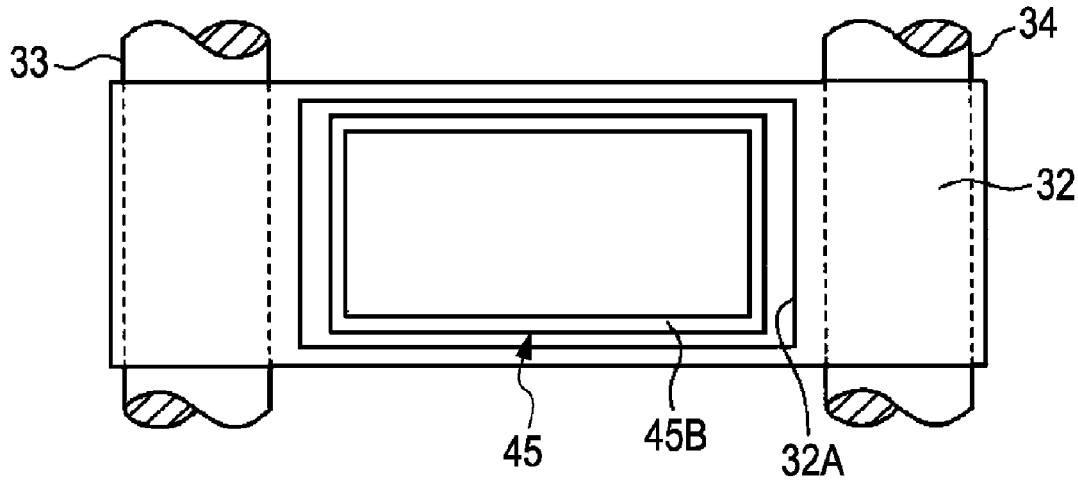
FIG. 8B is a partial view illustrating the cover unit wherein the flat belt is disposed at a non-covering position.

FIG. 8A shows the flat belt covering the cap, while FIG. 8B shows the configuration when the flat belt does not cover the cap. FIG. 8A shows the flat belt 32 that is wound toward the second roller 34 in what is referred to as a covering position (closing position). At the covering position, an upper opening of the cap 45 is covered by the flat belt 32. Then, as shown in FIG. 8B, the flat belt 32 is wound toward the first roller 33 that is positioned on the downstream side in the transport direction in order to obtain a non-covering position (opening position). At the non-covering position, a rectangular opening 32A is formed in the flat belt 32 at a position corresponding to the cap 45 with a sufficient size for the cap 45 to pass through the opening 32A. Therefore, when the flat belt 32 is disposed at the non-covering position, as shown in FIG. 8B, the cap 45 is exposed through the opening 32A. In the non-covered state, the cap 45 can pass through the opening 32A in a vertical direction between the retreated and capping positions without interfering with the flat belt 32. As shown in FIG. 9B, when the electromotive motor 49 is rotated forward with the flat belt 32 disposed at the non-covering position, the cap 45 passes through the opening 32A of the flat belt 32 and is lifted up to the capping position where the cap 45 comes into contact with the nozzle surface 16A of the recording head 16.

As shown in FIGS. 1, 3, and 4, the friction clutch gear mechanism 35 is provided at one end of each of the first roller 33 and the second roller 34. The friction clutch gear mechanism 35 includes a cylindrical portion 56 that is fixed to one end of either the first roller 33 or the second roller 34, a gear 36 that is coaxially mounted to the cylindrical portion 56 such that it can rotate relative to the cylindrical portion 56, and a coil spring 57 that causes the gear 36 to come into pressure contact with the end surface of the cylindrical portion 56. The gear 36 and the cylindrical portion 56 are frictionally engaged with each other by the force of the coil spring 57. Therefore, when a load that is stronger than the engagement friction force (static friction force) is applied to the cylindrical portions 56 (that is, the rollers 33 and 34), a contact surface (clutch surface) slips, and only the gear 36 runs idle. On the other hand, when the load applied to the cylindrical portion 56 is equal to or weaker than the engagement friction force, the gear 36 and the cylindrical portion 56 (that is, the rollers 33 and 34) are integrally rotated by the frictional engagement between the cylindrical portion 56 and the gear 36. In this embodiment, the friction clutch gear mechanism 35 forms a power transmission mechanism and a clutch mechanism.

Figure 7:
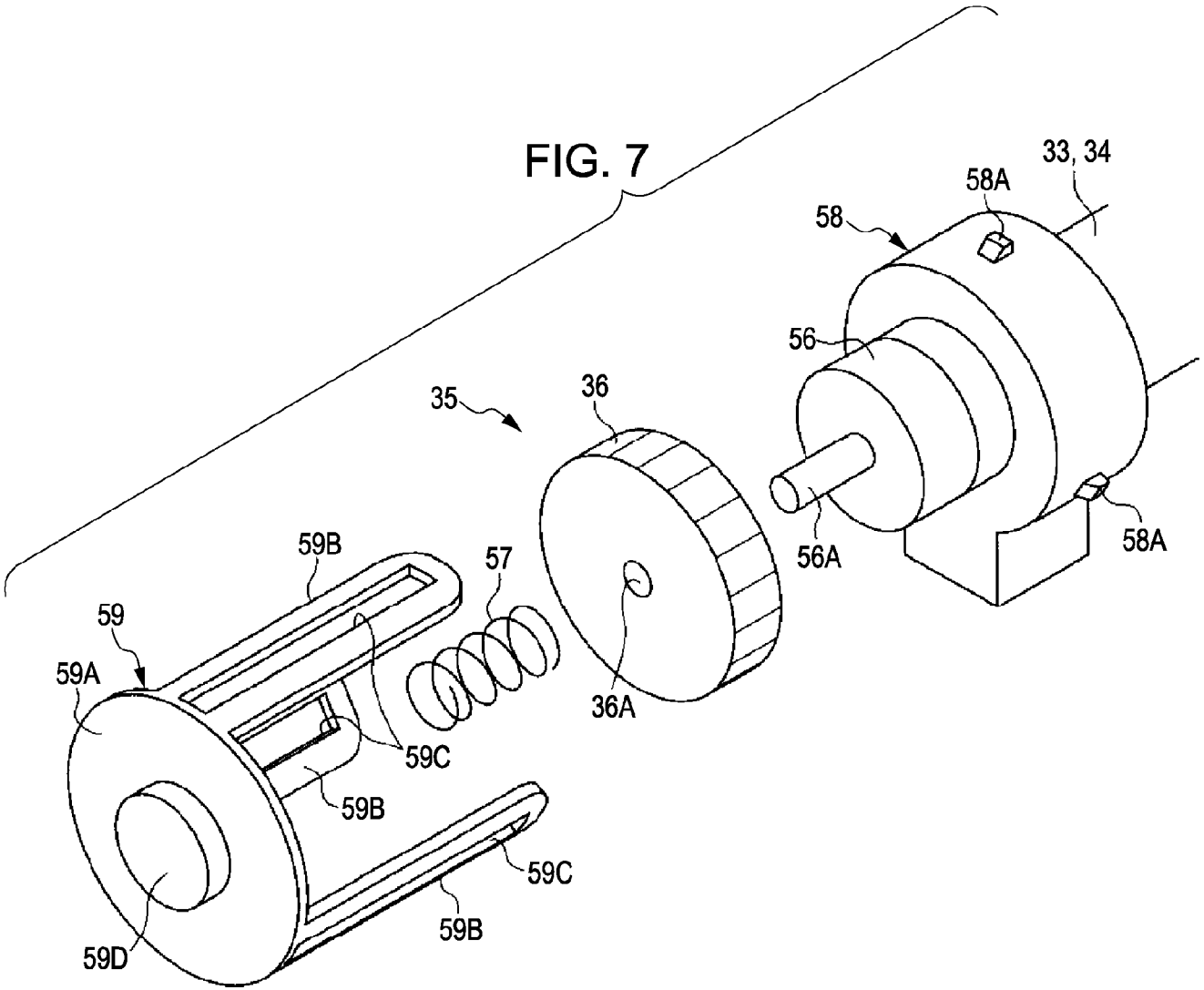
FIG. 7 is an exploded perspective view illustrating a friction clutch gear mechanism.

FIG. 7 is an exploded perspective view illustrating the friction clutch gear mechanism. As shown in FIG. 7, one end of the rollers 33 and 34 are rotatably supported by a bearing 58. A shaft 56A vertically protrudes from the center of the end surface of the cylindrical portion 56 fixed to one end of the rollers 33 and 34, and is fitted into a hole 36A of the gear 36. In this way, the gear 36 is coaxially mounted to the cylindrical portion 56 such that it can rotate relative to the cylindrical portion 56.

A plurality of locking protrusions 58A are formed on the outer circumferential surface of the bearing 58 at a plurality of different positions in the circumferential direction. In this embodiment, there are three different positions in the circumferential direction. A holding member 59 includes a disk-shaped holding portion 59A and a plurality of locking extension portions 59B (three in this example) that extend from the circumference of the holding portion 59A in the axial direction. A locking hole 59C comprising a slot is formed in each of the locking extension portions 59B. The friction clutch gear mechanism 35 is mounted to the end of each of the rollers 33 and 34 by fitting the locking holes 59C of the three locking extension portions 59B of the holding member 59 to the locking protrusions 58A of the bearing 58 while pressing the coil spring 57, with one end of the coil spring 57 coming into contact with the end surface of the gear 36 and the other end being inserted into a concave portion 59D of the holding portion 59A. That is, the coil spring 57 is provided between the gear 36 and the holding portion 59A of the holding member 59 with the shaft 56A being inserted into the coil spring 57, and the locking extension portions 59B of the holding member 59 are fitted to the locking protrusions 58A of the bearing 58. In this way, the coil spring 57 is provided in a compressed state between the gear 36 and the holding portion 59A in order to constantly press the gear 36 against the cylindrical portion 56. In this assembled state, the gear 36 is pressed against the end surface of the cylindrical portion 56 by the elastic force of the coil spring 57 in order to engage the end surfaces of cylindrical portion 56 and the gear 36. The holding member 59 is fixed to the bearing 58, and the gear 36, the cylindrical portion 56, and the roller 33 can be rotated relative to the holding member 59 and the bearing 58. In addition, the gear 36 is engaged with the gear 37 that is fixed to one end of each of the rollers 21-23 of the transport unit 13 within the area of the gap between the locking extension portions 59B of the holding member 59.

As shown in FIG. 5, the gear 37 fixed to the driving roller 21 is engaged with the gear 36 of the friction clutch gear mechanism 35 at one end of the first roller 33 of the cover unit 30 that is provided on the upstream side in the X direction and the gear 36 of the friction clutch gear mechanism 35 provided at one end of the second roller 34 of the cover unit 31 that is provided on the downstream side in the X direction. In addition, the gear 37 fixed to the driven roller 22 is engaged with the gear 36 of the friction clutch gear mechanism 35. Further, the gear 37 fixed to the driven roller 23 provided on the downstream side is engaged with the gear 36 of the friction clutch gear mechanism 35 provided at one end of the first roller 33.

In this way, when the electromotive motor 26 is rotated forward, the central driving roller 21 is rotated in the counterclockwise direction of FIG. 5, and power is transmitted through the transport belts 24 and 25 to rotate the driven rollers 22 and 23 in the counterclockwise direction. Then, the sheet of paper 12 on the transport belts 24 and 25 is transported in the X direction.

When the rollers 21-23 are rotated in the direction (forward direction) that the sheet is transmitted, the gears 36 are rotated forward (in the clockwise direction in FIG. 5) by the engagement between the gears 37 and the gears 36. The rotation of the gear 36 is transmitted to the cylindrical portion 56 that is frictionally engaged with the gear 36 in order to rotate the first and second rollers 33 and 34 in the forward direction (in the clockwise direction of FIG. 5). The forward rotation of the first and second rollers 33 and 34 causes the flat belts 32 to wind around the second roller 34 provided on the upstream side. When the flat belts 32 are wound around the second roller 34, the rotation of the first and second rollers 33 and 34 in the forward direction is restricted, and the load to rotate the rollers 33 and 34 forward increases. Then, the frictional engagement surface between the cylindrical portion 56 and the gear 36 of the friction clutch gear mechanism 35 slips, and the gear 36 runs idle. As a result, as shown in FIGS. 3 and 8A, the flat belt 32 that is wound to the end of the second roller 34 is maintained at the covering position where the portion of the flat belt 32 without an opening is arranged above the cap 45.

On the other hand, when the electromotive motor 26 is rotated backward, the central driving roller 21 is rotated in the clockwise direction of FIG. 5, and power is transmitted through the transport belts 24 and 25 to rotate the driven rollers 22 and 23 in the clockwise direction. When the rollers 21-23 are rotated in the backward direction (opposite to the transport direction), the gears 36 are rotated backward in the counterclockwise direction by the engagement between the gears 37 and the gears 36. The rotation of the gear 36 is transmitted to the cylindrical portion 56 that is frictionally engaged with the gear 36 to rotate the first and second rollers 33 and 34 in the backward or counterclockwise direction. The backward rotation of the first and second rollers 33 and 34 causes the flat belts 32 to wind around the first roller 33 provided on the upstream side. When the flat belts 32 are wound toward the first roller 33, the rotation of the first and second rollers 33 and 34 in the backward direction is restricted, and the load to rotate the rollers 33 and 34 backward increases. Then, the frictional engagement surface between the cylindrical portion 56 and the gear 36 of the friction clutch gear mechanism 35 slips, and the gear 36 runs idle. As a result, as shown in FIGS. 4 and 8B, the flat belt 32 that is wound toward the first roller 33 is maintained at the non-covering position where the portion of the flat belt 32 with the opening 32A is arranged above the cap 45.

Figure 10:
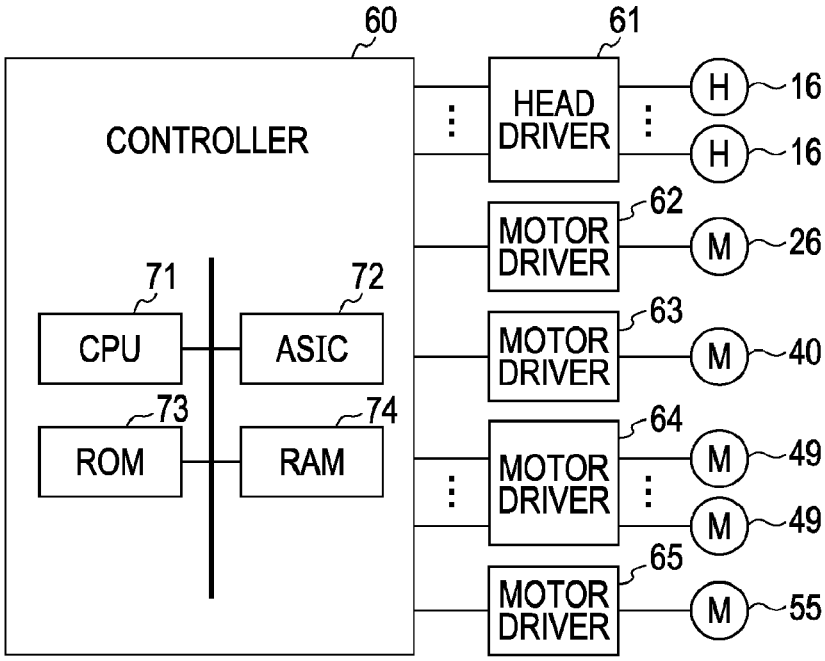
FIG. 10 is a block diagram illustrating the electrical structure of the printer.

FIG. 10 is a diagram illustrating the electrical structure of the printer. As shown in FIG. 10, the printer 11 includes a controller 60, which is a control unit, a head driver 61, and motor drivers 62-65. The controller 60 is connected to the recording heads 16 through the head driver 61, and is connected to the electromotive motor 26 of the transport unit 13 through the motor driver 62. In addition, the controller 60 is connected to the lift motor 40 through the motor driver 63, and is connected to the electromotive motor 49 of the cap unit 46 through the motor driver 64. Further, the controller 60 is connected to the pump motor 55 through the motor driver 65.

The controller 60 is provided with a CPU 71, an ASIC 72 (application specific IC), a ROM 73, and a RAM 74. The ROM 73 stores various programs executed by the CPU 71. The RAM 74 is used as a work memory that temporarily stores data processed by the CPU 71.

During a printing operation, the controller 60 rotates the electromotive motor 26 forward to operate the transport unit 13, thereby transporting the sheet of paper 12. Then, the controller 60 controls the recording heads 16 to discharge ink droplets onto the sheet of paper 12 transported on the transport belts 24 and 25 at dot positions of an image based on the print data (raster data) in order to print an image on the sheet of paper 12.

In this case, the rotational force of the rollers 21-23 of the transport unit 13 is transmitted to the rollers 33 and 34 by the engagement between the gear 37 fixed to one end of each of the rollers 21-23 and the gear 36 of the friction clutch gear mechanism 35 and the frictional engagement between the gear 36 and the cylindrical portion 56. The rollers 33 and 34 which receive the rotational force in the forward direction are rotated in the forward direction, and the flat belts 32 are wound around the second roller 34. When the flat belts 32 are wound toward the second roller, the flat belts 32 are disposed at the capping position where the flat belts 32 cover the caps 45. In this case, the rollers 21-23 are continuously rotated, but the forward rotation of the rollers 33 and 34 is restricted since the flat belt 32 is wound around the second roller. Therefore, an excessively large load is applied from the rollers 33 and 34 to the friction clutch gear mechanisms 35, and the frictional engagement surface between the gear 36 and the cylindrical portion 56 slips. Then, at that time, the friction clutch gear mechanism 35 is disengaged (frictionally disengaged). As a result, the connection between the gear 36 and the cylindrical portion 56 by frictional engagement is cut, and the gear 36 runs idle. Therefore, even when the transport belts 24 and 25 are driven in the X direction, the flat belt 32 is maintained at the covering position.

In this way, when paper powder is generated from the sheet of paper 12 while being transported, the paper powder is adhered to the upper surface of the flat belt 32, making it possible to prevent the paper powder from being adhered to the cap 45 covered with the flat belt 32. When printing is completed and the sheet of paper 12 is discharged, the driving of the electromotive motor 26 stops and then the electromotive motor 26 is rotated backward. That is, during a non-printing operation, the cap 45 caps the recording head 16, but during the capping operation, the electromotive motor 26 is rotated backward. The rotational force of the rollers 21-23 in the backward direction is transmitted to the rollers 33 and 34 by the engagement between the gear 37 and the gear 36 of the friction clutch gear mechanism 35 and the frictional engagement between the gear 36 and the cylindrical portion 56. The rollers 33 and 34 receive the rotational force in the backward direction and are rotated in the backward direction, and the flat belt 32 is wound to the end of the first roller 33. The flat belt 32 is disposed at the non-covering position where the portion of the flat belt 32 with the opening 32A is positioned above the cap 45. At the non-covering position, the driving of the electromotive motor 26 stops.

Thereafter, the electromotive motor 49 is rotated forward to lift the cap 45 through the opening 32A such that the cap 45 is disposed at the capping position. In one example, if the time since the previous cleaning process reaches a predetermined value as measured by the timer, the pump motor 55 is driven after the capping operation in order to operate the suction pump 54, in order to perform a cleaning process.

At that time, since dust, such as paper powder, is prevented from being adhered to the sealing member 45B of the cap 45, the sealing member 45B of the cap 45 disposed at the capping position comes into close contact with the nozzle surface 16A without any paper powder creating a gap. Therefore, it is possible to prevent deterioration in the sealing performance of the cap 45 due to the gap.

According to the above-mentioned embodiment, the following effects can be obtained.

(1) Since the cap 45 is covered with the flat belt 32 while the sheet is transported, it is possible to prevent paper powder from adhering to the cap 45. As a result, it is possible to prevent a capping error due to the deterioration in the sealing performance of the cap 45 from the paper powder adhering to the sealing member 45B of the cap 45. Therefore, it is possible to prevent an increase in the viscosity of ink in the nozzles due to the capping error. Further, it is possible to prevent the ink remaining in the cap 45 from drying due to the capping error, and thus it is possible to prevent the tube 53 connected to the caps 45 from being clogged. Further, it is also possible to prevent humidity in the cap 45 from being lowered during the capping operation. For example, when the internal vapor pressure of the cap 45 increases due to water (vapor) evaporated from the ink remaining in the cap, the humidity within the cap is maintained, and the evaporation of the ink contained in the nozzles is prevented and the speed at which the viscosity of ink in the nozzles increases is reduced. Therefore, it is possible to prevent the nozzles from being clogged due to an increase in the viscosity of ink in the nozzles or the drying of ink in the nozzles during the capping operation.

For example, in the prior art, when the ink in the nozzles is solidified due to the increase in the viscosity or the drying of the ink during the capping operation, the nozzles may not be sufficiently restored even when a cleaning process is performed during the next printing process, and thus a stronger cleaning process is needed. However, according to this embodiment, it is possible to effectively prevent the nozzles from being clogged. As a result, it is possible to prevent a large amount of ink that is not used for printing from being wasted in the stronger cleaning process.

(2) In the above-described embodiment, the electromotive motor 26, which is the power source of the transport unit 13, is used to rotate the rollers 33 and 34 of the cover units 30 and 31 in operative association with the rollers 21-23. In addition, when the rollers 21-23 are rotated in the forward transport direction, the flat belts 32 are disposed at the covering position so that the flat belts 32 cover the caps 45. When the electromotive motor 26 is rotated in the backward transport direction, the flat belts 32 are disposed at the non-covering position where the openings 32A in the flat belts 32 are positioned above the caps 45. Therefore, when the sheet is transported, the caps 45 are disposed at the covering position to prevent paper powder from being adhered to the caps 45. During the capping or cleaning process after printing is completed (after the transport of the sheet stops), the flat belt 32 is disposed at the covering position such that the cap 45 is lifted up to the capping position through the opening 32A. As such, the movement direction of the flat belt 32 is switched in operative association with the direction in which the transport unit 13 is driven. Therefore, a separate power source for the cover unit is not needed, and it is possible to displace the flat belt 32 between the covering position and the non-covering position at the appropriate intervals.

(3) The friction clutch gear mechanisms 35 are used as power transmission mechanisms that are capable of transmitting power between the rollers 21-23 of the transport unit 13 and the rollers 33 and 34 around which the flat belts 32 are wound. Therefore, when the electromotive motor 26 is rotated forward, the transport belts 24 and 25 are driven in the transport direction, and the flat belts 32 are wound around the second roller 34. When the flat belt 32 reaches the covering position (closing position), which is at the end of the second roller, the friction clutch gear mechanism 35 is disengaged, and the flat belt 32 is maintained at the covering position. Meanwhile, when the electromotive motor 26 is rotated backward after printing is completed, the flat belt 32 is wound around the first roller 33, and the friction clutch gear mechanism 35 is disengaged when the flat belt 32 reaches the non-cover position, which is the end of the first roller, and the flat belt 32 is maintained at the non-covering position where the opening 32A is positioned above the cap 45. Therefore, even when the electromotive motor 26 is continuously rotating to move the sheet of paper, the flat belt 32 can be maintained at the covering position. In addition, since capping is performed after the sheet of paper 12 is completely transported through the printer, the backward rotation of the electromotive motor 26 does not hinder the transport of the sheet of paper 12.

(4) The flat belts 32 for protecting a plurality of caps 45 are wound around the common rollers 33 and 34, and the friction clutch gear mechanism 35 is provided at one end of each of the rollers 33 and 34. Therefore, it is not necessary to provide the friction clutch gear mechanisms 35 at the ends of the individual caps 45, and it is possible to simplify the structure of the cover units 30 and 31.

Second Embodiment

A second embodiment of the invention differs from the first embodiment in that the cap 45 is lowered to come into contact with the lower surface of the flat belt 32.

Figure 11:
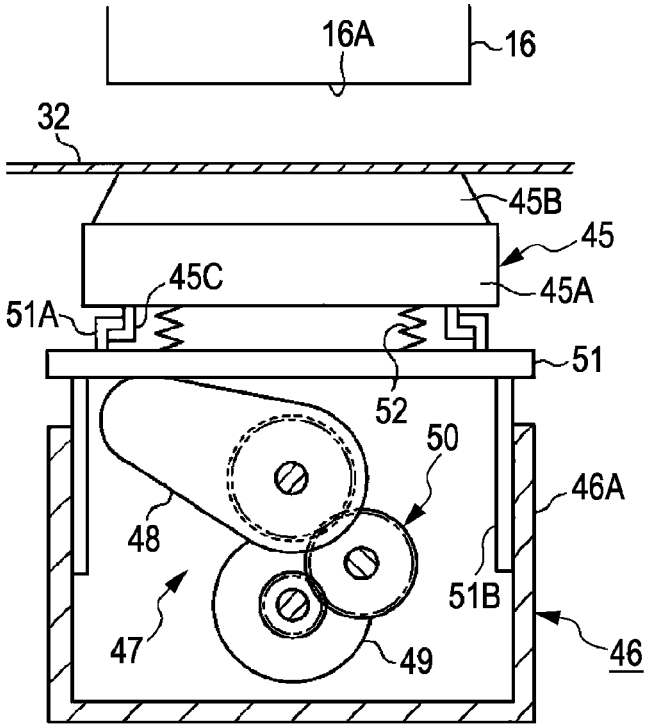
FIG. 11 is a front cross-sectional view illustrating the operation of a cap unit according to a second embodiment of the invention.

When the sheet is transported through the printer 11, the flat belt 32 is wound around the first roller 33 to place the flat belt 32 at the covering position shown in FIG. 11 in operative association with the driving of the transport unit 13. When the flat belt 32 is disposed at the covering position, the controller 60 rotates the electromotive motor 49 in the forward direction to slightly lift up the cap 45. In this case, the driving force of the electromotive motor 49 is set so that a sufficient lift is applied to the sealing member 45B of the cap 45, so that the cap 45 slightly presses upward on the lower surface of the flat belt 32. As a result, as shown in FIG. 11, the cap 45 comes into substantially close contact with the lower surface of the flat belt 32. Therefore, it is possible to prevent ink remaining in the cap 45 from drying while the cap 45 is retreated during a printing process. As a result, it is possible to prevent water from being evaporated from the ink remaining in the cap 45 during the capping operation, thereby ensuring the humidity of ink in the cap 45, and thus reducing the speed at which the viscosity of ink in the nozzles increases during the capping operation.

The embodiments of the invention are not limited to the above, but the following modifications can be made, along with those not expressly set forth without departing from the spirit or scope of the invention.

Modification 1

The clutch mechanism having the power transmission mechanism is not limited to a load switching type, wherein the friction clutch gear mechanism is disengaged when the load received from the cover units 30 and 31 increases. For example, any type of clutch mechanism may be used so long as a cover member can be maintained at the closing position even when the transport unit 13 is continuously driven. For example, a structure may be used wherein a clutch mechanism is disengaged regardless of load. For example, the gear 36 provided at one end of each of the first and second rollers 33 and 34 includes a toothed portion having teeth on an outer circumferential surface and a toothless portion without teeth, and the gear 37 of the transport unit is engaged with the toothed portion of the gear 36 of the cover unit to transmit power in the range in which the cover member is movable between the closing position and the opening position. Then, when the cover member is moved to the closing position or the opening position, the gear 37 of the transport unit corresponds to the toothless portion of the gear 36 of each of the cover units 30 and 31, and the position of the cover member is maintained. Further, a cam clutch mechanism may be used. For example, a cam mechanism may be used as the power transmission mechanism, wherein a cam follower guides the cover member to the closing position or the opening position, and the movement of the cam follower is restricted even when the rollers 21-23 are continuously rotated.

Furthermore, the cover member is not limited to the flat belt, but any member may be used as the cover member as long as it can have sufficient shape and size to cover the cap. For example, the cover member may be formed of a plate made of resin, metal, or inorganic materials and the plate may be configured to be movable. When a clutch mechanism is adopted, it is not necessary to set the closing position of the cover member at the end position. Therefore, a cover unit in which seamless flat belts are wound around the rollers 33 and 34 may be used.

Modification 2

The power transmission mechanism may be configured to have a clutch mechanism that can switch the rotational directions of the rollers 33 and 34 while the sheet is being transported. For example, a clutch mechanism that can selectively engage the gear 37 between a first gear and a second gear may be provided. In this case, the first gear is the gear of the friction clutch gear mechanism provided at one end of the first roller 33, and the second gear is engaged with the gear of the friction clutch gear mechanism provided at one end of the second roller 34 through an odd number of gears. Then, the gear 37 is selectively engaged with the first gear or the second gear by the clutch mechanism in order to select the rotational directions of the rollers 33 and 34. According to this structure, while the transport belt is driven, the clutch mechanism switches the engagement of the gear 37 with the first gear to the engagement of the gear 37 with the second gear to change the rotational directions of the first and second rollers 33 and 34, and thus the direction in which the flat belts 32 are wound around the rollers 33 and 34, in order to switch the flat belt 32 from the covering position to the non-covering position where flushing can be performed. As a result, when flushing is performed between sheets of paper, the flat belt 32 can be disposed at the non-covering position in order to perform a flushing operation on the cap 45 through the opening 32A without stopping the driving of the transport belt.

Modification 3

The gears 37 corresponding to the caps 45 may be provided on the rollers 21-23 at predetermined intervals in the axial directions thereof, and short rollers 33 and 34 and the friction clutch gear mechanism 35 may be formed for each flat belt 32. In addition, in the above-described embodiments, the friction clutch gear mechanisms 35 may be formed at both sides of each of the rollers 33 and 34.

Modification 4

The cover unit is not limited to a belt. For example, a mechanism that converts the rotational motion transmitted from the roller of the transport unit through a gear train into a rectilinear motion may be provided, and the cover member may be displaced between the closing position and the opening position by the converted rectilinear motion.

Modification 5

In the above-described embodiments, two columns of recording heads arranged in a zigzag configuration are provided, but the number of columns of recording heads is not limited to two. For example, four columns of recording heads may be provided. That is, two columns of recording heads may be provided in a zigzag configuration in two gaps among the rollers 21-23. In addition, only a pair of rollers may be provided in the transport unit, and two, three, four or more columns of recording heads may be provided between the pair of rollers. When two or more columns of recording heads are provided between the rollers, the two or more columns of recording heads may share the cover members. For example, a flat belt having a width that is equal to or slightly smaller than the maximum width of the sheet in the Y direction may be used, or the recording heads may share the flat belts among a plurality of columns of caps in the X direction between the rollers.

Modification 6

The transport unit is not limited to the transport belt unit, but may use a transport roller type in which a pair of transport rollers are rotated with a sheet interposed therebetween to transport the sheet of paper through the printer. In this transport roller type, the power of a power source of the transport unit may also be transmitted to the cover unit through a power transmission mechanism. In this case, it is possible to use the power of the transport unit to drive the cover unit. Therefore, a separate power source for the cover unit is not needed.

Modification 7

The power source (electromotive motor 26) for the transport unit 13 may also serve as a power source of the suction pump 54. In this case, when the electromotive motor 26 is rotated in a direction opposite to the transport direction, the suction pump 54 is operated. In addition, the power source of the transport unit 13 may also serve as a power source of the cap units 46. In this case, the electromotive motor 26 is rotated in a direction opposite to the transport direction in order to lift up the cap 45 to the capping position. However, it is preferable to provide a delay mechanism that stops the movement of the flat belt while the cap is lifted up. In this case, in the delay mechanism, for example, the rotating shaft of one gear in the lift mechanism 47 is coaxially arranged with an input shaft of the flat belt 32. When the rotating shaft is rotated by a predetermined angle that is smaller than 360° corresponding to the lift stroke of the cap 45, an engaging portion provided on the rotating shaft is engaged with an engaging portion provided on the input shaft of the flat belt 32, and power is transmitted to the flat belt 32 by the engagement between the two engaging portions.

Modification 8

In the above-described embodiments, an ink jet recording apparatus is used as an example of the liquid ejecting apparatus, but the invention is not limited to that configuration. For example, the invention can be applied to a liquid ejecting apparatus that ejects or discharges fluids other than ink, such as liquids, liquid materials having particles of a functional material dispersed therein or mixed with liquids, fluid materials, such as gels, and solids that can be ejected as liquids. Thus, the invention can be applied to a variety of liquid ejecting apparatuses, including liquid ejecting apparatuses that eject a liquid material having a material dispersed or dissolved therein for forming electrodes or a color material (pixel material) which is used to manufacture a liquid crystal display, an EL (electro-luminescent) display. The invention may also be applied to liquid ejecting apparatuses that eject bio-organic material used to manufacture bio-chips, liquid ejecting apparatuses used as precise pipettes that eject liquid material, liquid ejecting apparatuses that eject pinpoint amounts of lubricant to precise machines, such as watches and cameras, liquid ejecting apparatuses that eject a transparent resin liquid onto a substrate, such as an ultraviolet-curable resin, in order to form a minute hemispherical lens (optical lens) that is used for an optical communication element, liquid ejecting apparatuses for ejecting an acid or alkali etchant to etch, for example, a substrate, and fluid ejecting apparatuses that eject gel (for example, physical gel).

Further, the term 'fluid' is not limited to gases. For example, the fluid may include liquids (inorganic solvents, organic solvents, liquids, liquid resins, and liquid metals, including metal melt, liquid materials, and fluid materials.

What is claimed is:

1. A capping method in a liquid ejecting apparatus including a transport unit capable of transporting a target, liquid ejecting heads that are capable of ejecting a liquid onto the transported target, and cap units having caps that are capable of capping the liquid ejecting heads, the method comprising:

moving a plurality of cover members to a capping position where the cover members cover the caps of the cap units when the target is being transported; and moving the cover members to an opening position where the cover members do not hinder the movement of the caps between a retreated position and the capping position when the liquid ejecting heads are being capped by the caps, wherein the transport unit includes a power source and the cover units are connected to the transport unit through a power transmission mechanism such that the cover members are driven in association with the transport unit, such that the cover members are disposed at the closing position when the power source is driven in the direction that the target is transported, and the cover members are disposed at the opening position when the power source is driven in a direction opposite to the direction that the target is transported.

2. A liquid ejecting apparatus comprising:

liquid ejecting heads capable of ejecting a liquid onto a target;

a transport unit capable of transporting the target;

cap units that include caps which are provided opposite to the liquid ejecting heads with a transport path of the target being interposed between the caps and the liquid ejecting heads, the caps being movable between a capping position where the caps come into contact with the liquid ejecting heads and a retreated position where the caps are separated from the liquid ejecting heads; and cover units that include cover members, the cover units being capable of driving the cover members in association with the transport unit such that the cover members are disposed at a closing position where the caps are covered when the target is being transported and are disposed at an opening position where the caps are not covered during a capping operation, wherein the transport unit includes a power source and the cover units are connected to the transport unit through a power transmission mechanism such that the cover members are driven in association with the transport unit, such that the cover members are disposed at the closing position when the power source is driven in the direction that the target is transported, and the cover members are disposed at the opening position when the power source is driven in a direction opposite to the direction that the target is transported.

3. The liquid ejecting apparatus according to claim 2, wherein the transport unit is a transport belt unit that includes a belt driving shaft driven by the power source, belt driven shafts, a plurality of transport belts that are wound around the belt driving shaft and a belt driven shaft, the transport belts being alternately arranged between being wound between the driving shaft and a belt driven shaft located first in the direction that the target is transported and being wound between the driving shaft and a belt driven shaft located later in the direction that the target is transported, and the liquid ejecting heads, the caps, and the cover members are arranged in alternating positions corresponding to gaps between the transport belts, and the cover members are connected to the belt driving shaft and at least one of the belt driven shafts through the power transmission mechanism so as to be driven in association with the belt driving shaft.

4. The liquid ejecting apparatus according to claim 3, wherein the power transmission mechanism includes a clutch mechanism which is connected such that power can be transmitted to the clutch mechanism when the cover members are disposed in the movable range between the opening position and the closing position and the power is not transmitted when the cover members are moved to the closing position or the opening position.

5. The liquid ejecting apparatus according to claim 4, wherein the cover members are configured such that the opening position and the closing position are the end of the movable range between the opening position and the closing position, and the clutch mechanism is a load switch type mechanism that is disconnected when the cover members reach the end of the movable range and a load applied to the cover units is larger than the load applied to the cover units within the movable range of the cover members.

6. The liquid ejecting apparatus according to claim 3, wherein the cover members are flat belts that are provided between the caps and the liquid ejecting heads and have openings with a sufficient size for the caps to pass through, and the cover unit further includes a pair of rollers around which the flat belt is wound which are connected to the belt driving shaft and the belt driven shafts through the power transmission mechanisms, such that each of the flat belts is disposed such that a portion without the opening covers the cap when the power source is driven in the direction that the target is transported, and each of the flat belts is disposed such that the opening corresponds to the cap when the power source is driven in a direction opposite to the direction in which the target is transported.

7. The liquid ejecting apparatus according to claim 2, further comprising a control unit that is capable of controlling the driving of the transport unit, the cap units, and the cover units, wherein the control unit controls the power source of the transport unit such that the cover members are disposed at the closing portion when the target is transported and are disposed at the opening position during the capping operation, and the control unit controls the cap units such that the caps come into contact with the cover members disposed at the closing position while the target is transported.

8. A liquid ejecting apparatus comprising:

liquid ejecting heads capable of ejecting a liquid onto a target;

a transport unit capable of transporting the target along a transport path in a transport direction;

caps capable of capping the liquid ejecting head by coming into contact with the liquid ejecting head, the caps capable of being moved from a retreated position provided opposite to the liquid ejecting heads with the transport path being interposed between the caps and the liquid ejecting heads and a capping position where the caps come into contact with the liquid ejecting heads;

cover units capable of covering the caps at a closing position when the target is being transported and the caps are in the retreated position; and a power unit capable of driving the cover unit and transport unit in association such that the cover members are disposed at a closing position where the caps are covered when the target is being transported and are disposed at an opening position where the caps are not covered during a capping operation when the target is not being transported, wherein the cover units are connected to the transport unit through a power transmission mechanism, such that the cover members are disposed at the closing position when the power source is driven in the direction that the target is transported, and the cover units are disposed at an opening position when the power source is driven in a direction opposite to the direction that the target is transported.

9. The liquid ejecting apparatus according to claim 8, wherein the cover units are flat belts that are provided between the caps and the liquid ejecting heads which have openings with a sufficient size for the caps to pass through, and the flat belts are disposed such that a portion without the opening covers the cap during the closing position.

10. The liquid ejecting apparatus according to claim 8, further comprising a control unit that is capable of controlling the driving of the transport unit, the cap units, and the cover units by controlling the power source.

11. The liquid ejecting apparatus according to claim 8, wherein the transport unit is a transport belt unit that includes a belt driving shaft driven by the power source, belt driven shafts, and a plurality of transport belts that are wound around the belt driving shaft and a belt driven shaft, the transport belts being alternately arranged between being wound between the driving shaft and a belt driven shaft located first in the direction that the target is transported and being wound between the driving shaft and a belt driven shaft located later in the direction that the target is transported, wherein the liquid ejecting heads, the caps, and the cover units are arranged in alternating positions corresponding to gaps between the transport belts, and the cover units are connected to the belt driving shaft and at least one of the belt driven shafts through the power transmission mechanism so as to be driven in association with the belt driving shaft.

12. The liquid ejecting apparatus according to claim 11, wherein the power supply unit includes a clutch mechanism which is connected to the power supply unit such that power can be transmitted to the clutch mechanism when the cover units are disposed in the movable range between the opening position and the closing position.

13. The liquid ejecting apparatus according to claim 12, wherein the cover members are configured such that the opening position and the closing position are the end of the movable range between the opening position and the closing position, and the clutch mechanism is a load switch type mechanism that is disconnected when the cover units reach the end of the movable range and a load applied to the cover units is larger than the load applied to the cover units within the movable range of the cover units.

* * * * *